US007402781B2

(12) United States Patent
Kondo et al.

(10) Patent No.: US 7,402,781 B2
(45) Date of Patent: Jul. 22, 2008

(54) INDUCTION HEATING COOLER

(75) Inventors: Masao Kondo, Gifu (JP); Katsuharu Matsuo, Aichi (JP)

(73) Assignees: Kabushiki Kaisha Toshiba, Tokyo (JP); Toshiba Ha Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 0 days.

(21) Appl. No.: 10/545,378

(22) PCT Filed: Dec. 26, 2003

(86) PCT No.: PCT/JP03/17087

§ 371 (c)(1),
(2), (4) Date: Aug. 12, 2005

(87) PCT Pub. No.: WO2004/073355

PCT Pub. Date: Aug. 26, 2004

(65) Prior Publication Data

US 2006/0091135 A1 May 4, 2006

(30) Foreign Application Priority Data

Feb. 14, 2003 (JP) ..... 2003-036146

(51) Int. Cl.
*H05B 6/12* (2006.01)

(52) U.S. Cl. ..... 219/622; 219/620; 362/92

(58) Field of Classification Search ..... 219/622, 219/620, 621, 445, 640, 649, 460.1, 720; 362/92–93, 551, 555, 562; 385/32, 123, 385/901, 31

See application file for complete search history.

(56) References Cited

U.S. PATENT DOCUMENTS 4,484,809 A * 11/1984 Coleman ..... 399/159
6,914,223 B2 * 7/2005 Krause et al. ..... 219/460.1

(Continued)

FOREIGN PATENT DOCUMENTS

JP 61-30992 2/1986

(Continued)

OTHER PUBLICATIONS

International Search Report for PCT/JP03/17087 dated Apr. 20, 2004.

(Continued)

*Primary Examiner*—Quang T Van
(74) *Attorney, Agent, or Firm*—Pillsbury Winthrop Shaw Pittman, LLP

(57) ABSTRACT

An induction heating cooker includes an induction heating unit having an induction heating coil, a top plate made of a glass and mounted over the induction heating unit so that an object to be heated is placed on the top plate, and a light-emitting display section formed in the top plate for displaying an output state of the induction heating unit. The light-emitting display section includes a light-emitting element disposed below the top plate, and the top plate includes a portion corresponding at least to the induction heating coil and the light-emitting element. The portion is coated with a light transmissible thin film including a semiconductor, metal or metallic oxide and having such a light-transmittance characteristic that light emitted by the light-emitting element is viewed above the top plate.

5 Claims, 7 Drawing Sheets

U.S. PATENT DOCUMENTS

| | | | | |
|---|---|---|---|---|
| 7,109,450 | B2 * | 9/2006 | Kaji et al. | 219/620 |
| 2003/0006230 | A1 | 1/2003 | Kaji et al. | |
| 2003/0006231 | A1 | 1/2003 | Nagata et al. | |

FOREIGN PATENT DOCUMENTS

| | | | |
|---|---|---|---|
| JP | 61-30992 | U | 2/1986 |
| JP | 6-2389 | | 1/1994 |
| JP | P2003-015560 | A | 1/2003 |
| JP | 2003-086337 | | 3/2003 |
| JP | P2003-086337 | A | 3/2003 |
| JP | 2003-257601 | | 9/2003 |
| JP | 2003-338359 | | 11/2003 |
| JP | 2004211910 | A | 7/2004 |
| WO | 01/72087 | A1 | 9/2001 |

OTHER PUBLICATIONS

Supplemetary European Search Report.
Notification of Reasons for Refusal dated Sep. 11, 2007.

* cited by examiner

INDUCTION HEATING COOLER

CROSS REFERENCE TO RELATED APPLICATIONS

This is the U.S. National Stage of PCT/JP2003/017087, filed Dec. 26, 2003, which in turn claims priority to Japanese Patent Application No. 2003-036146, filed Feb. 14, 2003, both of which are incorporated herein by reference in their entireties.

TECHNICAL FIELD

This invention relates to an induction heating cooker having a top plate which is provided over induction heating means and on which an object to be heated is placed.

BACKGROUND ART

Induction heating cookers comprise a top plate and induction heating means including an induction heating coil disposed below the top plate and an inverter supplying a high-frequency current to the induction heating coil. Some induction heating cookers are provided with another type of heating means such as nichrome wire coils (radiant heater). Appearances of the induction heating cooker are reduced when the heating means are viewed through the top plate from outside. In view of this, for example, JP-B-6-2389 discloses an induction heating cooker including a top plate made of a white ceramic glass or a transparent glass with an underside to which a heat-resistant paint is applied.

Induction heating cookers have recently been provided with a display in the top plate so that an output state of the heating means can readily be confirmed. The display comprises a plurality of light-emitting diodes provided below the top plate and energized so that the output state of the heating means is displayed. However, when the top plate made from the white ceramic glass or the transparent glass with the underside coated with the heat-resistant paint as described above, the top plate cannot transmit light emitted by the light-emitting diodes of the display.

In view of the aforesaid problem, when the top plate is made of a transparent glass coated with paint, part of the applied paint corresponding to the display is removed so that the top plate transmits the light emitted by the light-emitting diode transmits the light. However, in the case where the paint is partially removed from the top plate, components of the light-emitting diode are viewed through the paint-removed part of the top plate even when the light-emitting diode is turned off, whereupon the appearances of the induction heating cooker is reduced. Further, light emitted by the light-emitting diode leaks through the paint-removed part of the top plate or the interior of the cooker below the top plate can be viewed when illuminated by external light. In particular, since the induction heating coil does not generate heat by itself, the display is disposed near the induction heating coil in order that heating by the induction heating coil may definitely be indicated. Accordingly, when paint is removed from the part of the top plate corresponding to the display, the induction heating coil is viewed through the paint-removed part, whereupon the appearances of the induction heating cooker are reduced.

Further, the light-emitting diode comprises one emitting red light and the top plate is made of a colored glass. The colored glass allows light with the wavelength longer than the red one to pass therethrough but cuts off visible light. In this construction, the interior of the cooker below the top plate is hard to view. However, the color and color tone are limited in this top plate. In particular, metallic color tones which have recently been used by preference cannot be obtained from the colored glass. Accordingly, even when the color and color tone of the induction heating cooker body is diversified, the top plate cannot be matched with them.

Therefore, an object of the present invention is to provide an induction heating cooker which is provided with a display in the top plate and in which the color and color tone of the top plate can be diversified without reducing the appearances of the cooker.

DISCLOSURE OF THE INVENTION

The present invention provides an induction heating cooker comprising induction heating means having an induction heating coil, and a top plate made of a glass and provided over the induction heating means so that an object to be heated is placed thereon, and a light-emitting display section provided in the top plate for displaying an output state of the induction heating means. In this construction, the light-emitting display section includes a light-emitting element disposed below the top plate, and the top plate includes a portion corresponding at least to the induction heating coil and the light-emitting element, said portion being coated with a light transmissible thin film comprising a semiconductor, a metal or a metal oxide and having such a light-transmittance characteristic that light emitted by the light-emitting element is viewed above the top plate.

The induction heating coil is disposed near the top plate. Accordingly, the induction heating coil is sometimes viewed even when the top place comprises a colored glass which transmits light emitted by the light emitting element. In the above-described construction, however, the light transmissible thin film coated on the top plate can reliably prevent the induction heating coil from being viewed above the top plate. Furthermore, the top plate transmits at least part of the light emitted by the light emitting element while the thickness of the light transmissible thin film is adjusted and the material for the thin film is selected so that the top plates with a number of colors and color tones are constructed.

BEST MODE FOR CARRYING OUT THE INVENTION

Figure 1:
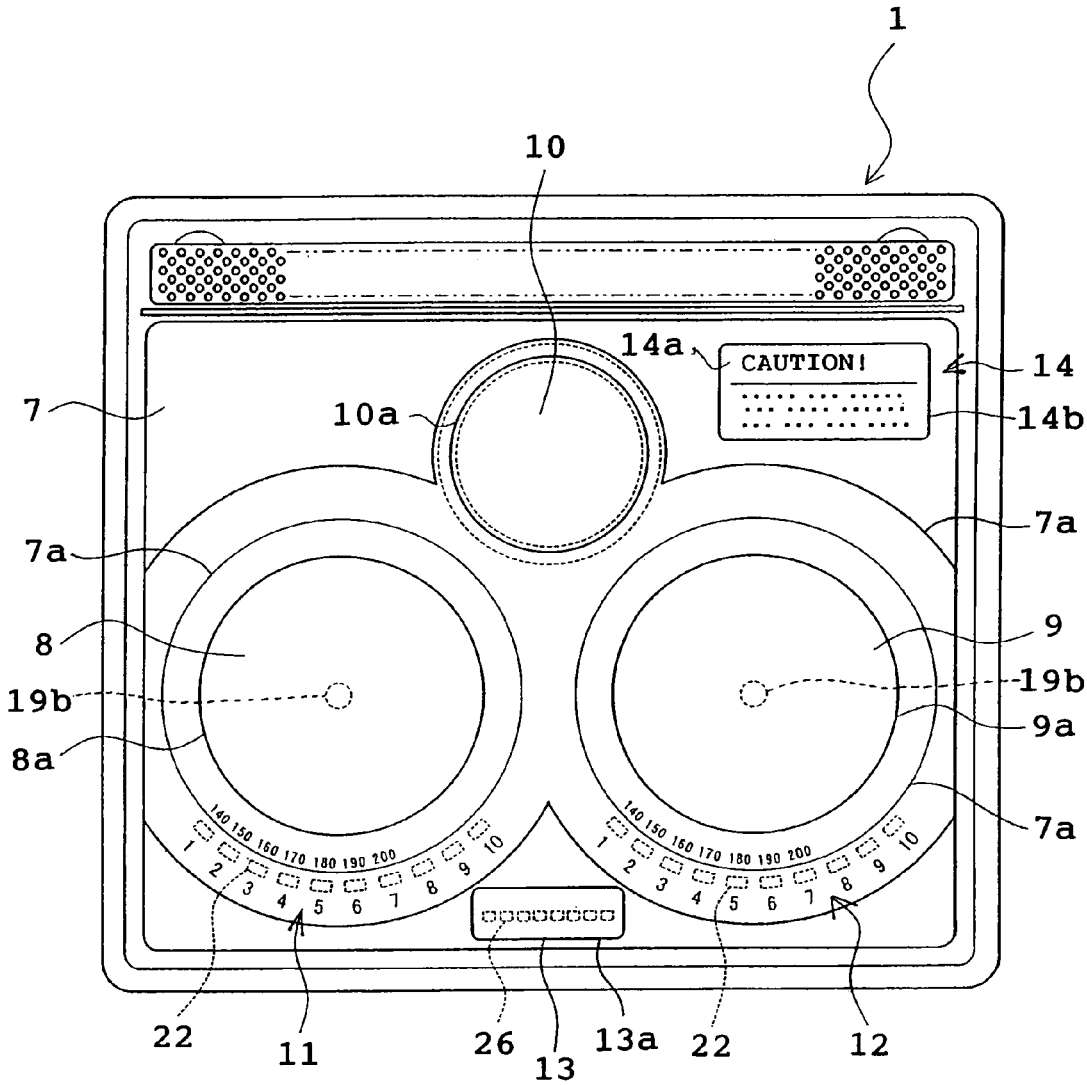
FIG. 1 is a top view of the overall induction heating cooker in accordance with a first embodiment of the present invention.
Figure 2:
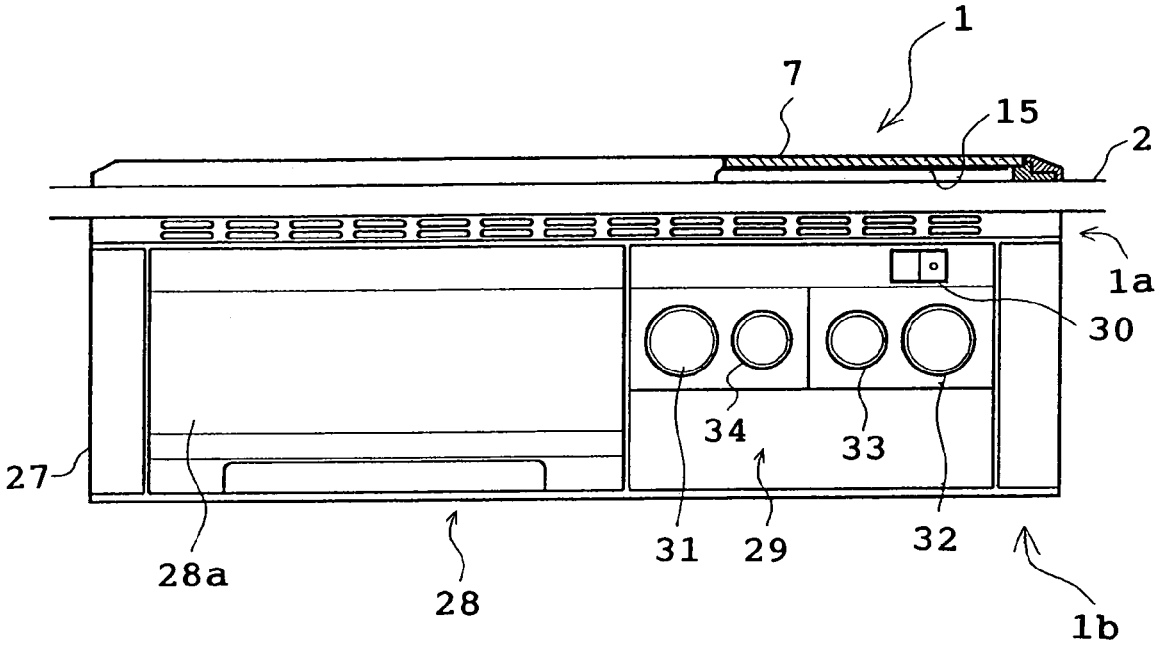
FIG. 2 is a front view of the induction heating cooker.

Several embodiments of the present invention will be described with reference to the drawings. FIGS. 1 to 5 illustrate a first embodiment of the invention. In the first embodiment, the invention is applied to an induction heating cooker built in a system kitchen. FIGS. 1 and 2 illustrate an overall induction heating cooker of the first embodiment. An induction heating cooker body 1 comprises an upper unit 1*a* fitted with a cooking cabinet 2 from above and a lower unit 1*b* fitted with the cooking cabinet 2 from the front so that the lower unit 1*b* is located below the upper unit 1*a*. The upper unit 1*a* comprises induction heating coils 3 and 4 each serving as a heating unit, a thin rectangular casing 6 for enclosing a radiant heater 5 (the latter two being shown in FIG. 3), and a top plate 7 closing an upper opening of the casing 6.

Two induction heating sections 8 and 9 are juxtaposed on a front part of an upper side of the top plate 7 so as to correspond to the induction heating coils 3 and 4 respectively. A heater heating section 10 is provided on a central rear of the upper side of the top plate 7 so as to correspond to the radiant heater 5. A pan or pot (neither shown) containing an object to be heated, for example, food to be cooked or the like is placed on the each of the heating sections 8 to 10. Circular lines 8*a* to 10*a* and designed lines 7*a* are printed on the upper side of the top plate 7. The circular lines 8*a* to 10*a* define regions of the heating sections 8 to 10 respectively.

Coil output display sections 11 and 12 (each serving as light-emitting display section) are formed along the lines 8*a* and 9*a* on the front portions of the induction heating sections 8 and 9 to display output states of the induction heating coils 3 and 4 respectively. Each of the coil output display sections 11 and 12 comprises a plurality of light-emitting elements such as light-emitting diodes (LED's) 22. Numerals are printed on the upper side of the top plate 7 so as to correspond to LED's 22 respectively. The numerals indicate output levels of the induction heating coils 3 and 4 and temperatures of oil in the cooking of, for example, one of Japanese dishes, "tempura."

A heater output display section 13 is provided on the central front of the upper side of the top plate 7. The heater output display section 13 displays an output state of the radiant heater 5. The heater output display section 13 includes a plurality of light-emitting elements, for example, light-emitting diodes (LED's) 26. A rectangular frame 13*a* is printed on the upper side of the top plate 7 to define a disposition region of LED's 26.

Caution display sections 14 are provided on the right and left rear portions of the top plate 7 for displaying precautions for operation and the like respectively. One of the caution display sections 14 is shown in FIG. 1. Each caution display section 14 includes characters 14*a*, a frame 14*b* surrounding the characters 14*a* and the like.

The top plate 7 is made of a transparent glass plate having heat resistance. The transparent glass plate has an underside on which a light transmissible thin film 15 is provided. The light transmissible thin film 15 is formed by coating a metal material such as titan by the sputtering. The light transmissible thin film 15 has a thickness set at several hundreds nm so that the top plate 7 transmits light with wavelength longer than the red as compared with the other visible light. As the result of the above-described construction, the top plate 7 is viewed as having a metallic color tone.

Figure 4:
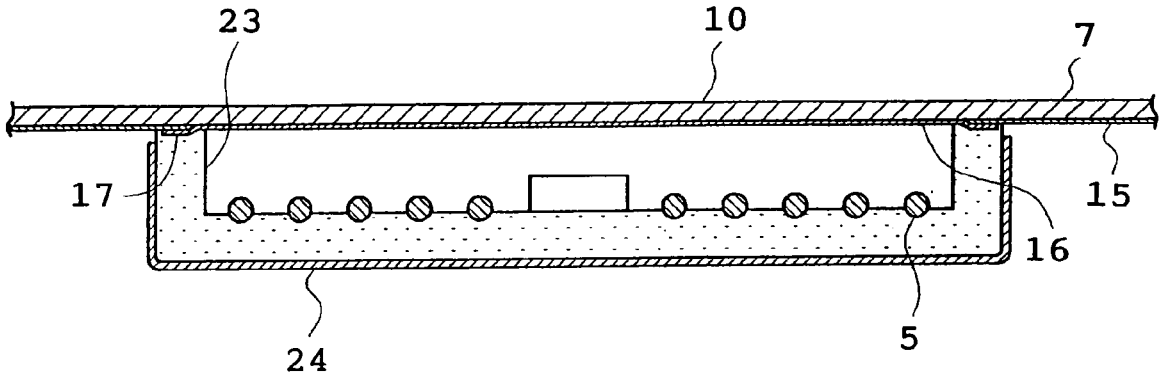
FIG. 4 is an enlarged longitudinal section of the heater heating section and its periphery.

The thin film 15 is formed substantially on the entire underside of the top plate 7 except the part of the top plate 7 corresponding to the heater heating section 10 as shown in FIGS. 2 and 4. Accordingly, the heater heating section 10 serves as a heat radiating opening. A heat-resistant paint film 16 is provided on the underside of the part of the top plate 7 corresponding to the heater heating section 10. The color and the color tone of the heat-resistant paint film 16 are set so as to be approximated to those of the top plate 7 with the thin film 15 formed thereon.

The paint film 16 is coated on the underside of the top plate 7 so that a circumferential edge thereof overlaps the thin film 15. The circumferential edge of the paint film 16 overlapping the thin film 15 will be referred to as "overlap portion 17."

Figure 5:
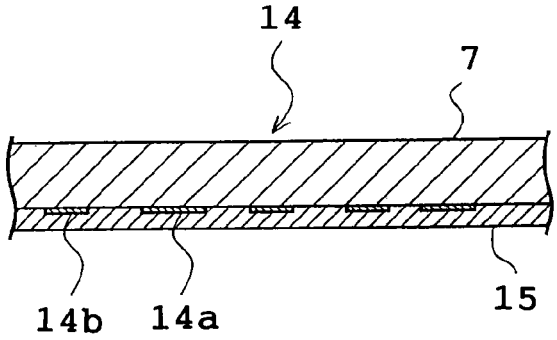
FIG. 5 is an enlarged longitudinal section of a portion of the top plate on which a caution display section is provided.

The characters 14*a*, the frame 14*b* and the like of the caution display section 14 are printed on the underside of the top plate 7 as shown in FIG. 5. Thus, the caution display section 14 serves as a printed display section. In the embodiment, the light transmissible thin film 15 is coated after the caution display section 14 has been printed on the underside of the top plate 7.

Induction heating coils 3 and 4, and a radiant heater 5 are disposed below the induction heating sections 8 and 9, and the heater heating section 10 in the casing 6 respectively. The radiant heater 5 includes a nichrome wire which heats up when a DC current is supplied thereto. Thus, the radiant heater 5 serves as a heating unit. A cooling fan 18 is provided in the right rear interior of the casing 6.

Magnetic shield rings 19*a* are disposed near the induction heating coils 3 and 4 respectively. Temperature sensors 19*b* are disposed in the centers of the induction heating coils 3 and 4 respectively. An inverter 19*c* is provided below the induction heating coil 4 in the casing 6 to supply high-frequency current to the coils 3 and 4. The induction heating coils 3 and 4, the inverter 19*c*, the magnetic shield rings 19*a*, the temperature sensors 19*b* and the like constitute an induction heating assembly which serves as induction heating means.

The induction heating assembly 19 is screwed in the casing 6 so as to be located below the induction heating sections 8 and 9 while the induction heating coils 3 and 4 are adjacent to the underside of the top plate 7. A board mounting member 20 is screwed to a front half of the outer periphery of the induction heating assembly 19. A printed board 21 is mounted on the board mounting member 20. The aforesaid LED's 22 are mounted on the printed board 21. The board mounting member 20, the printed board 21 and LED's 22 constitute the coil output display sections 11 and 12.

Figure 3:
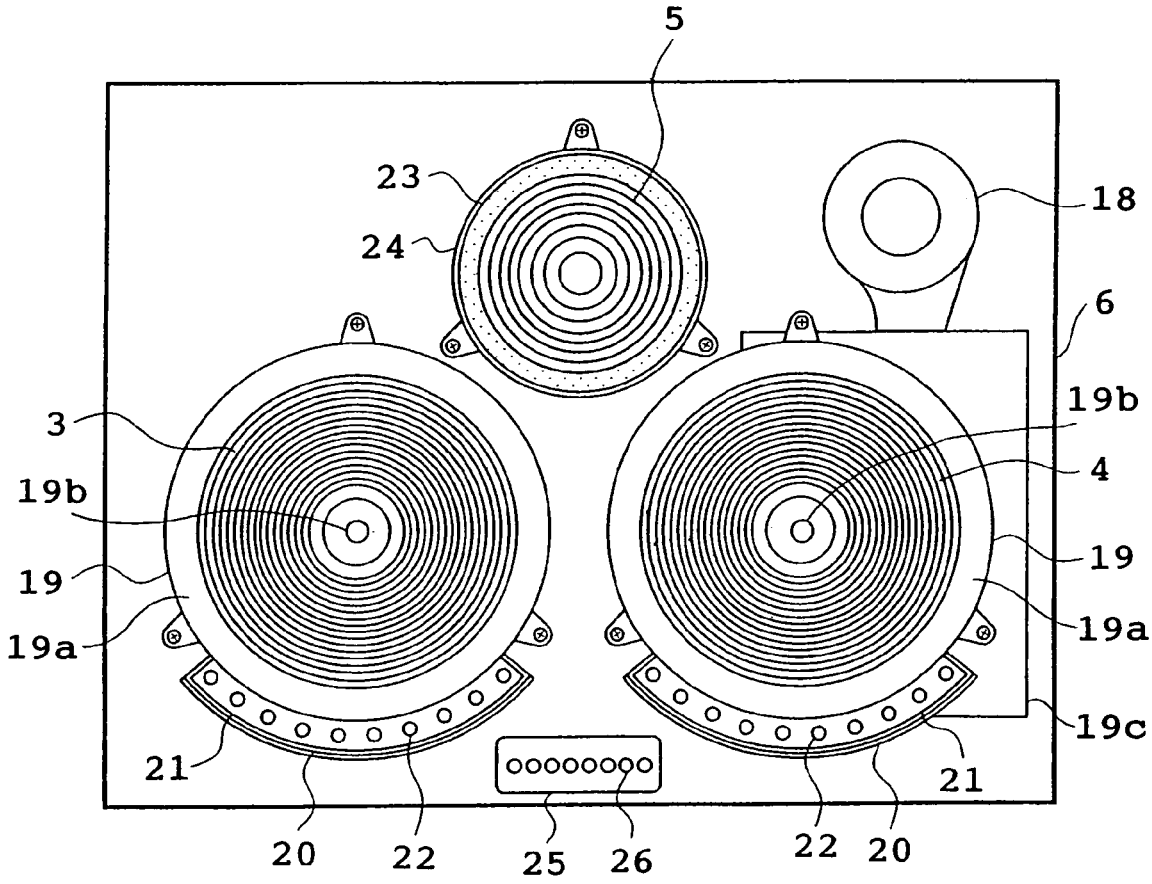
FIG. 3 is a plan view of the induction heating cooker with the top plate detached.

A circular heat-insulating container or base 23 is fixed in the casing 6 and has an open top. The radiant heater 5 is disposed on the bottom of the base 23. The base 23 is screwed to the bottom of the casing 6 with a support frame 24 interposed therebetween. An upper end of the base 23 is in abutment with the overlap portion 17 of the thin film 15 and the paint film 16 on the underside of the top plate 7 as shown in FIG. 4. A printed board 25 is disposed at the central front in the casing 6 as shown in FIG. 3. A plurality of LED's 26 are mounted on the printed board 25. The printed board 25 and LED's 26 constitute a heater output display section 13. Each of LED's 22 and 26 emits red light having a wavelength ranging from 600 to 650 nm. The top plate 7 transmits part of light emitted by LED's 22 and 26 (about 10%) such that the light is visible above the top plate 7.

Referring to FIG. 2, the lower unit 1*b* includes a roaster 28 provided in the left interior of a cabinet 27 and an operation panel 29 mounted on a right portion of a front door 28*a* of the roaster 28. The roaster 28 includes a sheathed heater (not shown) as a heat source. On the operation panel 29 are provided a power switch 30 and dials 31 to 34 for turning on and off the induction heating coils 3 and 4, the radiant heater 5 and the sheathed heater of the roaster 28 and adjusting output levels of the induction heating coils 3 and 4, the radiant heater 5 and the sheathed heater of the roaster 28 respectively. Each of the dials 31 to 34 is coupled to a switch mechanism having a rotary encoder and a push-push switch.

In the above-described construction and arrangement, the heating units are turned on and off when the power switch 30 is turned on and the respective dials 31 to 34 are depressed. Further, output levels of the heating units are adjusted when the respective dials 31 to 34 are turned. For example, when the induction heating coil 3 is used for cooking, a pot is placed on the induction heating section 8 and the dial 31 is depressed. The induction heating coil 3 is then energized at maximum output, so that all the LED's 22 for the induction heating coil 3 are turned on. When the dial 31 is turned in this state, the output of the induction heating coil 3 is adjusted and the number of LED's 22 according to the output state is turned on.

The top plate 7 transmits light emitted by the LED's 22 turned on. Accordingly, the user counts the number of energized LED's 22 or views the numeral printed near the energized LED 22, thereby confirming the output state of the induction heating coil 3. Particularly in the embodiment, LED's 22 are disposed in the vicinity of the induction heating coil 3. Accordingly, although the induction heating coil 3 does not heat up itself, the user can find that the induction heating coil 3 is energized when viewing the energized LED's 22.

In the foregoing embodiment, the top plate 7 is made by forming the light transmissible thin film 15 on the underside of the transparent glass. Accordingly, the top plate 7 can transmit light emitted by LED's 22 and 26 when the thickness of the light transmissible thin film 15 is adjusted. Thus, a part of the light transmissible thin film 15 need not be removed from the top plate 7 in order that the top plate 7 may transmit the light emitted by LED's 22 and 26. Further, the color tone of the transparent glass plate on which the thin film 15 is formed can be varied according to the thickness of and material for the thin film 15. Consequently, the color of the top plate 7 can be diversified.

The light transmissible thin film 15 formed on the underside of the top plate 7 has a function as a mirror. More specifically, when the characters 14*a* and the like of the caution display section 14 and the light transmissible thin film 15 are spaced away from each other, the characters 14*a* printed on the top plate 7 are disadvantageously viewed as being doubled. In the foregoing embodiment, however, the characters 14*a* and the like of the caution display section 14 are printed on the underside of the top plate 7 and the light transmissible thin film 15 are then formed on the printed characters 14*a* and the like. As a result, the characters 14*a* and the like of the caution display section 14 and the light transmissible thin film 15 are close to each other. Accordingly, even when reflected in the light transmissible thin film 15 as the mirror, the characters 14*a* and the like can be prevented from being hard to view since the reflected characters substantially correspond with directly viewed characters.

Infrared rays emitted by the radiant heater 5 would be reflected in the light transmissible thin film 15 such that heat is shut up in the base 23. For the purpose of preventing this, a painted film 16 is applied to a region of the heater heating section 10 on the underside of the top plate 7 without the light transmissible thin film 15 being formed thereon. This prevents an excessive increase in the temperature of the radiant heater 5 and a sudden drop in the heating efficiency. Moreover, the radiant heater 5 can be prevented from being viewed externally.

The circumferential edge of the paint film 16 overlaps the thin film 15. Accordingly, the underside of the top plate 7 does not include any portion on which neither paint film 16 nor light transmissible thin film 15 is formed.

It is usually difficult to overlap the circumferential edge of the paint film 16 uniformly on the light transmissible thin film 15. Mere overlap looks poor. In view of this, the upper end of the base 23 is in abutment with the overlap portion 17 of the thin film 15 and the paint film 16 on the underside of the top plate 7. Consequently, although the overlap portion 17 is viewed clearly from above the top plate 7, reduction in the appearances of the cooker due to this can be prevented.

Figure 6:
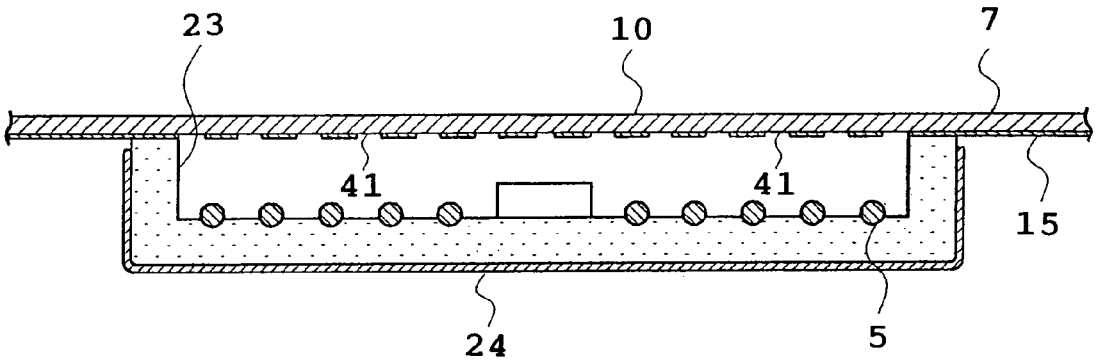
FIG. 6 is a view similar to FIG. 4, showing the induction heating cooker in accordance with a second embodiment of the invention.

FIG. 6 illustrates a second embodiment of the invention. Only the differences of the second embodiment from the previous embodiment will be described. Identical or similar parts are labeled in the second embodiment by the same reference symbols as in the first embodiment. In the second embodiment, a number of heat-radiating portions 41 are provided on a part of the light transmissible thin film 15 corresponding to the heater heating section 10. Each heat-radiating portion 41 is formed into the shape of a circular hole. The heat-radiating portions 41 are formed with no light transmissible thin film, namely, the light transmissible thin film on the underside of the top plate corresponding to the heater heating section 10 is polka-dotted. Thus, heat generated by the radiant heater 5 can also be prevented from being shut up in the base 23 when a part of the light transmissible thin film 15 is removed from the underside of the heater heating section 10 of the top plate 7.

A part of the radiant heater 5 is visible through the heat-radiating portions 41. However, when each one of the heat-radiating portions 41 is rendered small, degradation of appearance can be limited even though the radiant heater 5 is visible through the heat-radiating portions 41.

Figure 7:
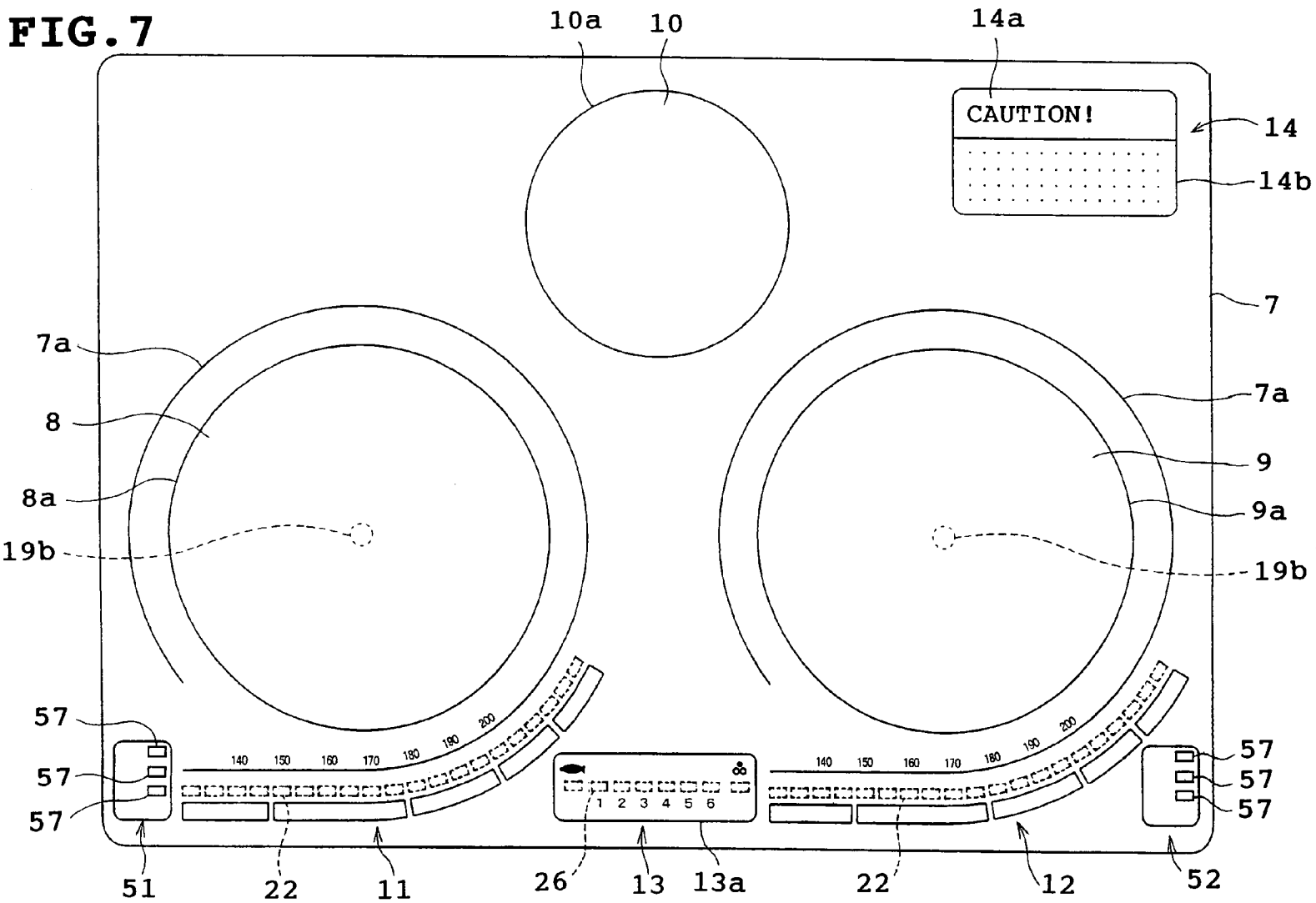
FIG. 7 is a top view of the top plate employed in the induction heating cooker in accordance with a third embodiment of the invention.
Figure 8:
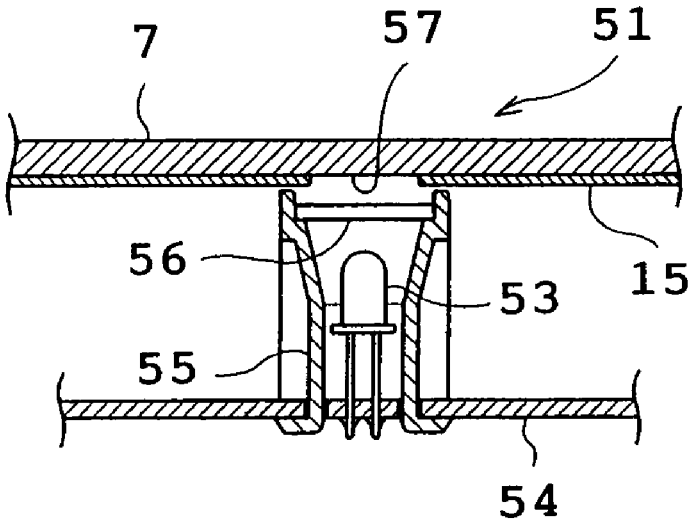
FIG. 8 is a longitudinal section of the light-emitting diode constituting the menu display section.

FIGS. 7 and 8 illustrate a third embodiment of the invention. Only the differences of the third embodiment from the first embodiment will be described. Identical or similar parts are labeled in the third embodiment by the same reference symbols as in the first embodiment. In the third embodiment, output display sections 11 and 12 are provided on the top plate 7 for displaying output states of the induction heating coils 3 and 4 respectively. Menu display sections 51 and 52 are provided on the top plate 7 for displaying types of cooking menus.

The output display sections 11 and 12 are located in front of the induction heating sections 8 and 9 respectively. In the embodiment, right halves of the output display sections 11 and 12 are disposed along the frames 8*a* and 9*a* respectively. Left halves of the output display sections 11 and 12 are disposed along the front end of the top plate 7. As in the first embodiment, each of the output display sections 11 and 12 includes a plurality of LED's 22. Numerals and characters indicative of output levels are printed on the upper side of the top plate 7.

The menu display sections 51 and 52 are located at the left and right front ends of the top plate 7 respectively. Each of the menu display sections 51 and 52 includes LED's 53 the number of which depends upon settable types of cooking menus, for example, three. LED's 53 are mounted on a printed board 54. A cylindrical protector 55 surrounds each LED 53 and extends from the printed board 54 nearly to the underside of the top plate 7. A diffuser plate 56 is attached to an upper portion of each protector 55. Each LED 53 serves as light-emitting element and emits green light having a wavelength differing from that of each LED 22 and ranging from 500 to 550 nm. Accordingly, the top plate 7 transmits almost no light emitted by each LED 53. Thus, portions of the top plate 7 corresponding to the respective LED's 53 serves as transmission openings on which the light transmissible thin films 15 are not formed.

Automatic cooking can be carried out using the induction heating coils 3 and 4 in the embodiment. A menu setting key (not shown) on the operation panel 29 is operated so that one of three automatic cooking menus, for example, is set. For example, when automatic cooking with use of the induction heating coil 3 is set, for example, the corresponding LED 53 of the menu display section 51 is turned on and one or more LED's 22 of the output display section 11 are turned on according to the output state of the induction heating coil 3. In this case, the top plate 7 on which the light transmissible thin film 15 is formed transmits light emitted by LED's 22. Furthermore, light emitted by LED's 53 passes through the diffuser plate 56 and the light transmitting opening 57. Accordingly, the user can confirm turn-on of LED's 22 and 53 from above the top plate 7. Further, particularly in the embodiment, the light emitted by each LED 22 has a wavelength range differing from that of the light emitted by each LED 53. This can clearly define the differences in the functions between the output display sections 11 to 13 and the menu display section 51. Additionally, since each LED 53 is surrounded by the protector 55, the interior of the casing 6 can be prevented from being viewed through the light transmitting opening 57.

Figure 9:
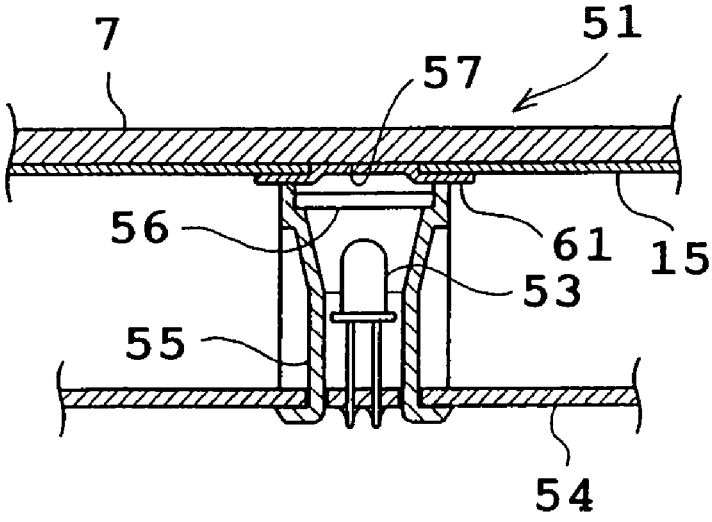
FIG. 9 is a view similar to FIG. 8, showing the induction heating cooker in accordance with a fourth embodiment of the invention.

FIG. 9 illustrates a fourth embodiment. Only the differences of the fourth embodiment from the third embodiment will be described. Identical or similar parts are labeled in the fourth embodiment by the same reference symbols as in the third embodiment. In the fourth embodiment, a translucent film 61 is provided on the light transmissible thin film 15 so as to close each light transmitting opening 57. The translucent film 61 is made from a metallic material by the sputtering as the light transmissible thin film 15 is made. The translucent film 61 has a thickness set so that part of the green light emitted by each LED 53 passes therethrough. Accordingly, the translucent film 61 is viewed as having a metallic color tone as the light transmissible thin film 15 has.

The above-described construction of the fourth embodiment can achieve the same effect as that of the third embodiment. Particularly in the fourth embodiment, the overall top plate 7 has substantially the same color tone as the result of provision of the translucent film 61, whereupon the design of the induction heating cooker can be improved.

The present invention should not be limited by the foregoing embodiments. The embodiments may be modified as follows. The top plate may be made by forming the light transmissible thin film on a colored glass plate having a specific light transmission characteristic. In this case, the light transmissible thin film may be formed only on the portions of the top plate 7 corresponding to the induction heating coils and the display sections. In this construction, heat generating means such as the radiant heater is visible from above the top plate. However, since the aforesaid heating means has a structure less complicated than the induction heating coil, the appearances of the cooker can be prevented from being reduced although the heating means is visible from above the top plate.

Further, the light transmissible thin film and the translucent film may be formed on the upper side of the glass plate. Further, two glass plates may be stacked to be formed into the top plate, and the light transmissible thin film and the translucent film may be formed on a side of one glass plate opposed to a side of the other glass plate. Since the light transmissible thin film and the like is not exposed, they can be prevented from being damaged or peeled.

The material for the light transmissible thin film and the translucent film should not be limited to titan. The material may include a metal such as Ag, Cu and Al, a metal oxide such as $TiO_2$, $SnO_2$, $InO_2$, etc. and a semiconductor such as Si. More specifically, the film material may be selected according to the color and color tone of the top plate or a wavelength range of each LED constituting the display section. Further, the thickness of the light transmissible thin film or the translucent film may be set at several tens to several hundreds microns according to the wavelength range of the light emitting element emitting light which is to be transmitted therethrough. In this case, a manner of forming the light transmissible thin film or the translucent film may include a physical process such as vacuum evaporation or a chemical process such as spraying or dipping.

The translucent film may be formed by applying a plastic sheet to or baking paint on the surface of the top plate. Further, infrared light emitting diodes may be used in stead of LED's 53 as shown in FIGS. 8 and 9. An infrared detecting element may be disposed on a range hood provided above the induction heating cooker, so that infrared communication can be carried out between the aforesaid infrared LED's and the infrared detecting element. In this case, a translucent film 71 having an infrared transmissible characteristic is formed on the light transmissible thin film 15 so as to close each light transmitting opening 57.

A two-color light emitting diode may be used as each LED constituting the menu display section, so that light of one color is emitted during execution of a cooking menu and light of the other color is emitted during interrupt of the cooking menu. Further, a liquid crystal display (LCD) serving as the aforesaid second light emitting means may be disposed below the top plate for displaying the time. In this case, the time can be viewed more easily irrespective of peripheral brightness when LCD is provided with a back light.

The invention may be applied to induction heating cookers provided with only an induction heating coil. The invention may also be applied to induction heating cookers placed on the cooking cabinet in use as well as those built in the cooking cabinet.

INDUSTRIAL APPLICABILITY

As described above, the present invention is suitable for an induction heating cooker built in a system kitchen, the induction heating cooker and the system kitchen having a unified color tone.

The invention claimed is:

1. An induction heating cooker comprising:

induction heating means having an induction heating coil;

a top plate made of a glass and provided over the induction heating means so that an object to be heated is placed thereon;

a heater which is provided below the top plate so as to self-heat;

a light-emitting display section provided in the top plate for displaying an output state of the induction heating means;

a light-emitting element disposed below the top plate, wherein:

a heat-insulating container is provided below the top plate and having an open top, the heat-insulating container having a bottom on which the heater is disposed;

the top plate includes a portion corresponding at least to the induction heating coil and the light-emitting element, said portion being coated with a light transmissible thin film comprising a semiconductor, a metal or a metal oxide and having such a light-transmittance characteristic that a larger amount of light from the light-emitting element is allowed to pass therethrough than other visible light;

the top plate has a heat-radiating opening formed in an entire or part of region thereof located over the heater, the heat-radiating opening being provided with a heat-resistant paint film; and the heat-resistant paint film has a circumferential edge including a part overlapping the light transmissible thin film on a circumferential edge of the heat-radiating opening, and the heat-insulating container has an upper end surface which is arranged so as to abut against the overlapping part.

2. The induction heating cooker according to claim 1, wherein the light-emitting element is disposed near the induction heating coil.

3. The induction heating cooker according to claim 1, further comprising another light-emitting element provided below the top plate for emitting light belonging to a different wavelength range from light emitted by the light-emitting element of the light-emitting display section, wherein the top plate has a light-transmissible opening formed by removing the light transmissible thin film from a region thereof corresponding to said another light-emitting element.

4. The induction heating cooker according to claim 1, wherein the light-transmissible opening is provided with a translucent film having such a light-transmittance characteristic that element is viewed above the top plate.

5. The induction heating cooker according to claim 1, wherein the top plate includes a side on which a light transmissible thin film is coated and the side of the top plate is provided with a printed display section printed before the coating of the light transmissible thin film.

* * * * *